US005429157A

United States Patent [19]

Plemons

[11] Patent Number: 5,429,157

[45] Date of Patent: Jul. 4, 1995

[54] BLADE TYPE DROP WIRE

[76] Inventor: G. Dale Plemons, Plemons Rd., Crandall, Ga. 30711

[21] Appl. No.: 222,170

[22] Filed: Apr. 4, 1994

Related U.S. Application Data

[63] Continuation of Ser. No. 117,413, Sep. 7, 1993, abandoned.

[51] Int. Cl.[6] ..... D03D 51/32

[52] U.S. Cl. ..... 139/353; 139/368

[58] Field of Search ..... 139/358, 368, 353; 28/187; 200/61.13, 61.18

[56] References Cited

U.S. PATENT DOCUMENTS

| | | | |
|---|---|---|---|
| 774,316 | 11/1904 | Foster . | |
| 1,930,151 | 10/1933 | Smith | 139/368 |
| 1,964,356 | 6/1934 | Howe | 139/368 |
| 2,814,088 | 11/1957 | Ayars et al. | 139/353 |

FOREIGN PATENT DOCUMENTS

| | | | |
|---|---|---|---|
| 979480 | 4/1951 | France | 139/368 |

*Primary Examiner*—Andrew M. Falik
*Attorney, Agent, or Firm*—Michael Drew

[57] ABSTRACT

An elongated blade (20) has a slot (22) for receiving a contact bar (15) and an eyelet (30) at one end for receiving passing yarn (11). The eyelet (30) has a curled lip (34). The upper end of the slot has a slanted, or oblique, edge (23) which forms an angle with each side of the slot (22). A flange which includes an oblique edge flange (24) and side edge flanges (26, 28), extends around the perimeter slot (22) except at the intersection of the oblique edge (23) and the longer side of the slot. In one preferred embodiment of the drop wire (10), the blade is twisted (32) between the slot (22) and the eyelet (30) to position the eyelet (30) and slot (22) 90° with respect to one another. In another embodiment (12), the blade is flat.

15 Claims, 2 Drawing Sheets

BLADE TYPE DROP WIRE

This application is a continuation of application Ser. No. 08/117,413 filed Sep. 7, 1993, now abandoned.

TECHNICAL FIELD OF THE INVENTION

The present invention relates to drop wires, and more particularly to a blade type drop wire of unitary construction whose eyelet reduces friction with respect to a strand of yarn, and which is reinforced.

BACKGROUND OF THE INVENTION

A problem in using drop wires to detect breakage of strands of yarn in a warp stop motion assembly is that yarn may be degraded as it passes through the eyelet of the drop wire. Degradation is caused by friction between the eyelet and moving yarn. It is also important that a thin blade type drop wire be sturdy enough to withstand repeated movements and handling without becoming deformed. If the drop wire becomes deformed its effectiveness in a stop motion assembly may become diminished or may be completely eliminated. It can be appreciated that it would be desirable to have a drop wire wherein friction between the eyelet of the drop wire and yarn is decreased. It can also be appreciated that it would be desirable to have a blade type drop wire that is sturdy enough to withstand repeated movement and handling.

SUMMARY OF THE INVENTION

It is an object of the invention to provide a drop wire having an eyelet which minimizes friction with yarn passing through the eyelet.

It is a further object of the invention to provide a blade type drop wire which is capable of enduring repeated movement and handling.

In a drop wire according to the present invention, an elongated blade has a slot for receiving a contact bar and an eyelet at one end for receiving passing yarn. The eyelet has a curled lip. The upper end of the slot has a slanted, or oblique, edge which forms an angle with each side of the slot. A flange extends around the slot except at the intersection of an oblique edge and the longer side of the slot. In one preferred embodiment of the drop wire the blade is twisted between the slot and the eyelet to position the eyelet and slot 90° with respect to one another. In another embodiment, the blade is flat.

Other aspects, objects, features, and advantages of the present invention will become apparent to those skilled in the art upon reading the detailed description of preferred embodiments.

DETAILED DESCRIPTION OF PREFERRED EMBODIMENTS OF THE INVENTION

Figure 4:
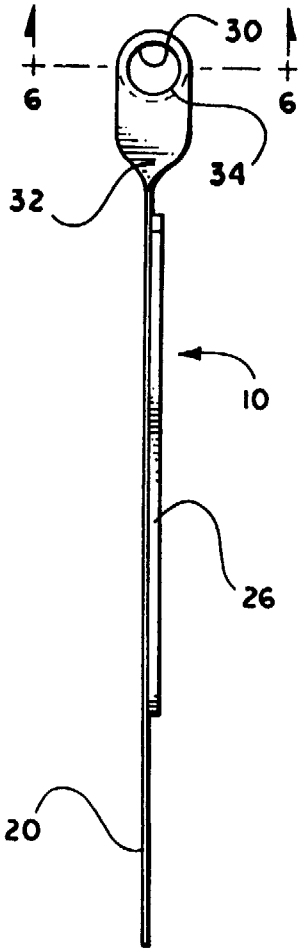
FIG. 4 is a left side elevational view of the invention of FIG. 1.

While the specification concludes with claims particularly pointing out and distinctly claiming the subject matter which is regarded as the present invention, the invention will now be described with reference to the following description of embodiments taken in conjunction with the accompanying drawings. Throughout the drawings, the same reference numerals are used to refer to like features.

Figure 1:
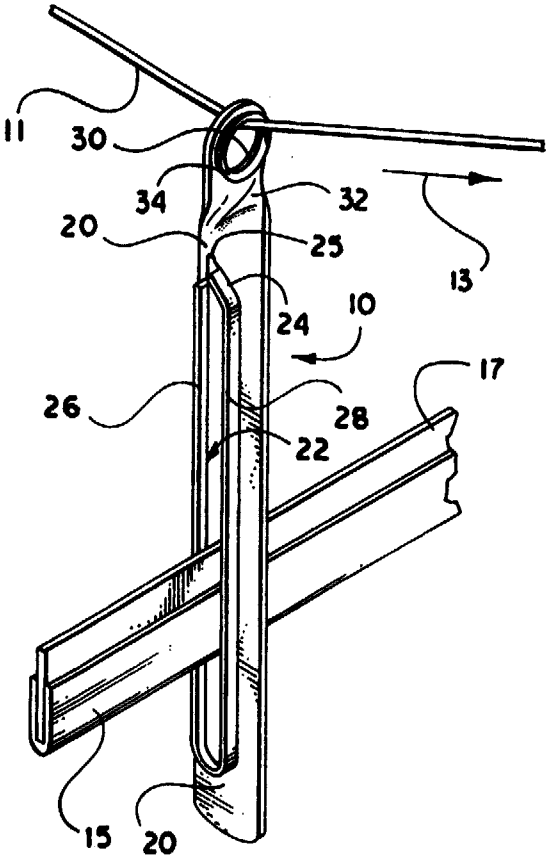
FIG. 1 is an isometric illustration of a drop wire according to a preferred embodiment of the invention, shown with a strand of yarn and a contact bar.

Referring first to FIG. 1, therein is illustrated in an isometric view a drop wire 10 according to a preferred embodiment of the invention. FIG. 1 also shows the drop wire 10 in a typical environment in which it would be used. A strand of yarn 11 traveling in a direction illustrated by numeral 13 passes through the eyelet 30 of the drop wire 10. A contact bar 15 passes through a slot 22 in the drop wire 10. The drop wire 10 is of the blade type, consisting of a flat electrically-conductive metal. The drop wire 10 has an elongated body 20 which has a slot 22 extending lengthwise through its body 20. One end of the slot 22, the topmost end, has a slanted, or oblique, edge 23 that forms an angle with each side of the slot 22. In particular, an acute angle is formed between the oblique edge 23 and the longer side of the slot 22. A preferred angle formed is about 30°. A flange extends around the edge of the slot 22 except at the intersection of the longer edge and oblique edge 23 of the slot 22. The oblique-edge flange 24 and long-side flange 26 do not meet. However, the oblique-edge flange 24 extends to the shorter-side flange 28. An eyelet 30 is formed at one end of the body 20. For convenience of reference, this end of the drop wire 10 will be referred to as the top end. The plane of the eyelet 30 is perpendicular to the plane of the slot 22. The body 20 of the drop wire 10 contains a twist 32 between the slot 22 portion and the eyelet 30 which produces the 90° alignment of the slot 22 and eyelet 30 with respect to one another. The eyelet 30 contains a curled lip 34 which extends upwardly and outwardly from the opening of the eyelet 30.

Figure 3:
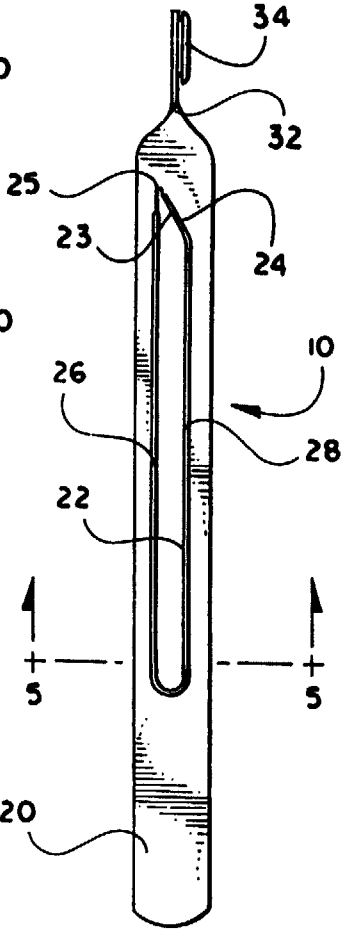
FIG. 3 is a front elevational view of the drop wire of FIG. 1.
Figure 2:
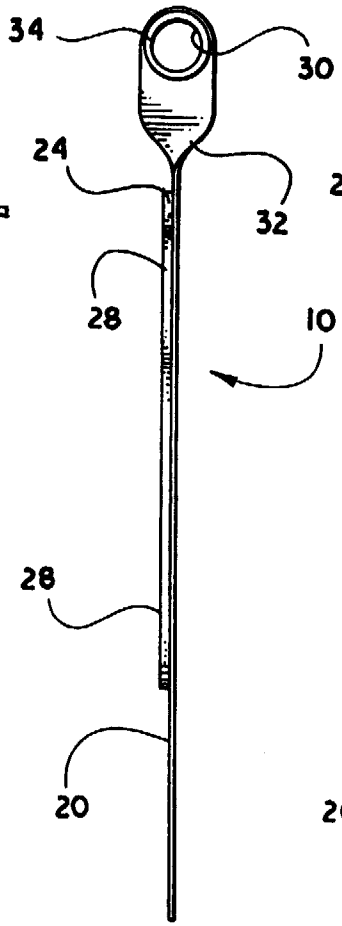
FIG. 2 is a right side elevational view of the drop wire of FIG. 1.

The features described above may be further understood by referring now simultaneously to the views of the drop wire 10 illustrated in FIGS. 2, 3, and 4. As a convenient point of reference, these three views have been referred to as right side, front and left side, respectively. These three views illustrate in particular the perpendicular relationship between the slot 22 and eyelet 30. Referring momentarily particularly to FIG. 2, the side view shows a head-on view of the eyelet 30. From this view, the slot 22 is not seen because it is perpendicular to the eyelet 30. The manner in which the curled lip 34 of the eyelet 30 extends outwardly of the eyelet 30 is also clearly shown. FIG. 2 also clearly shows the extension of the slot flanges 24, 26, 28 from the body 22 of the drop wire 10. Referring now particularly to the frontal view of FIG. 3, the slot 22 is seen head-on while the eyelet 30 is seen from the side. The angular shape and unflanged portion 25 at the top of the slot 22 created by the oblique edge 23 and its flange 24 and the sides and side flanges 26, 28 of the slot 22 are clearly shown. From the perspective of FIG. 3, as a reference point, the flanges 24, 26, 28 extend upwardly (that is, outwardly) from the plane of the body 20. The manner in which the curled lip 34 of the eyelet 30 extends upwardly from the body 20 portion of the drop wire 10 containing the eyelet 30 may be clearly seen. The manner in which the lip 34 curls outwardly from the eyelet 30 is also clearly shown. The left side view of FIG. 4 shows the reverse of FIG. 2, with the longer-side flange 26 being visible.

Figure 5:
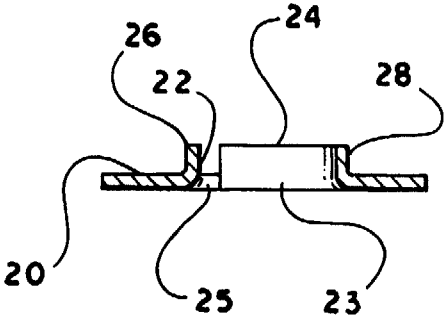
FIG. 5 is a sectional illustration of the slot of the drop wire of FIG. 1, taken along line V—V of FIG. 3.
Figure 6:
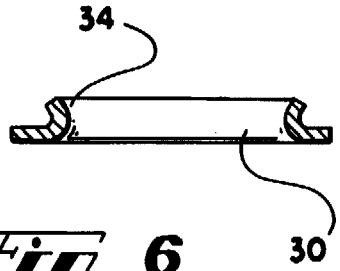
FIG. 6 is sectional illustration of the eyelet of the drop wire of FIG. 1, taken along line VI—VI of FIG. 4.

Two of the features of the drop wire 10 are illustrated in more detail by sectional views of parts of the drop wire 10. Referring now to the sectional illustration of FIG. 5, taken along line V—V of FIG. 4, the manner in which the flanges 26, 28 extend from and are connected to the sides of the slot 22 in the body 20 of the drop wire 10 is clearly shown. Referring now to FIG. 6, a section view of the eyelet 30 taken along line VI—VI of FIG. 4, therein is clearly shown the manner in which the lip 34 curls upwardly and outwardly.

Figure 9:
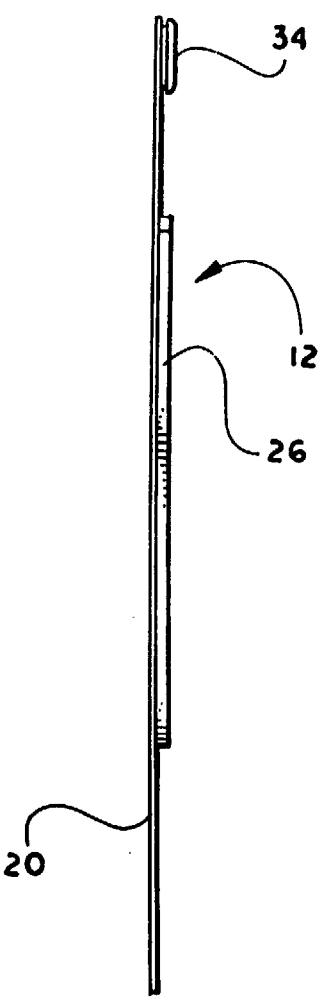
FIG. 9 is a left side elevational view of the drop wire of FIG. 7.
Figure 8:
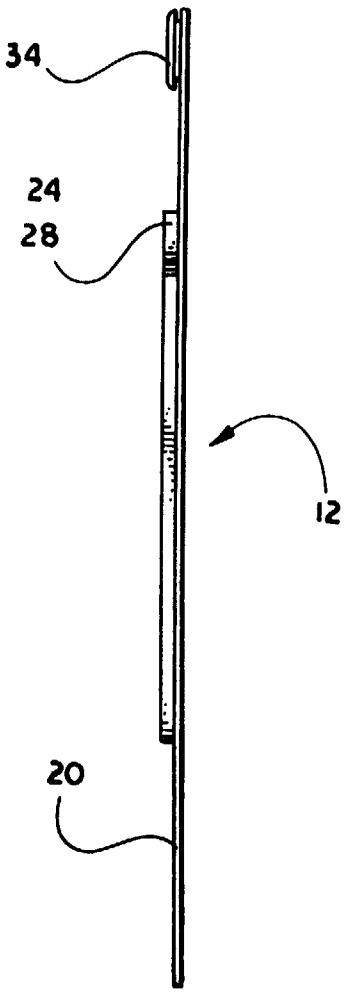
FIG. 8 is a right side elevational view of the drop wire of FIG. 7.
Figure 7:
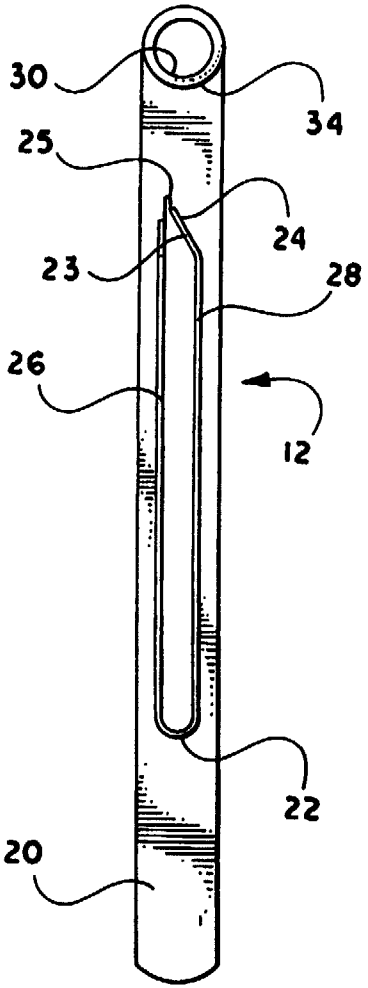
FIG. 7 is a front elevational view of a drop wire according to another preferred embodiment of the invention.

Referring now to FIGS. 7, 8 and 9, a flat blade type drop wire 12 according to another preferred embodiment of the invention is illustrated. For convenience of reference, FIG. 7 is referred to as a front view while FIGS. 8 and 9 are the right and left side views, respectively. The drop wire 12 is flat rather than twisted as the above-described drop wire 10. In this flat type of drop wire 12 according to a preferred embodiment of the invention, the features described above are the same, except for the twist 32. The drop wire 12 has an elongated body 20 containing a flanged slot 22. As above, the flanges sections 24, 26, 28 do not meet at the intersection of the longer side and oblique edge 23 of the slot 22. The drop wire 12 also has an eyelet 30 with a curled lip 34 at an end of the body 20. The slot 20 and eyelet 30 of the flat drop wire 12 lie in the same plane of reference. The side views of FIGS. 8 and 9, further illustrate the manner in which the slot 20 and eyelet 30 lie in the same plane and the identical features described above with respect to the twisted drop wire 10.

The eyelet 30 of the drop wires 10, 12 described herein engage a strand of yarn 11 with reduced friction because the opening of the eyelet has a curled lip 34 which presents a smooth surface upon which the yarn 11 may travel. Friction is reduced even more between the eyelet 30 of the twisted embodiment drop wire 10 and a strand of yarn 11 because the plane of the eyelet 30 is perpendicular to the plane of the slot 20. Thus, when one or multiple drop wires 10 are mounted upon a contact bar 15, the yarn may travel in a direction 13 which is perpendicular to the contact bar 15. This allows the yarn to pass through each eyelet 30 perpendicular to the plane of the eyelet 30. When a strand 11 is allowed to pass through the eyelet 30 in a direction perpendicular to the plane of the eyelet 30, friction between the strand 11 and perimeter of the eyelet 30 is minimized because the yarn 11 can contact the perimeter of the eyelet 30 at a single, minimized point of contact.

The drop wire 10, 12 is may be made from an electrically conducted material such as steel. A suitable type of steel is 1075 annealed steel distributed by Ulbrich Steel Company located in Georgia. To make the drop wire 10, 12 more sturdy, the steel may be hardened by generally know steel-hardening processes. In particular, the steel may be hardened by the application of a nickel coating. Hardening the drop wire 10, 12, and in particular hardening through nickel coating, also provides the advantage of making the surface of the drop wire 10 smoother, further minimizing friction between the eyelet 30 and yarn 11.

The flange, including flange sections 24, 26, 28, which extends around the perimeter of the slot 22 makes the drop wire 10, 12 more difficult to bend or otherwise deform. When the drop wire 10, 12 is reinforced by the addition of a flange around the perimeter of the slot 22, by leaving the slot 22 "unflanged" 25 at the apex of the slot, where the slot 22 of a falling drop wire 10, 12 is engaged by the blade 17 of the contact bar 15, the blade 17 is better able to nest in the unflanged portion. This interaction prevents a fallen drop wire 10, 12 from teetering upon the blade 17 after it has fallen. A teetering or otherwise non-stationary drop wire is not a reliable electrical connection which is desired in a drop wire, warp stop motion assembly.

The drop wire 10, 12 is cost efficient because it can be made from a single strip of material to form a unitary structure. The drop wire 10, 12 described above minimizes friction between a strand of yarn 11 and the eyelet 30 of the drop wire 10, 12 and is a unitary, reinforced structure.

As should be apparent from the foregoing specification, the invention is susceptible to being modified with various alterations and modifications which may differ from those which have been described in the preceding specification and description. Accordingly, the following claims are intended to cover all alterations and modifications which do not depart from the spirit and scope of the invention.

What is claimed is:

1. A drop wire comprising:

an elongated body defining an aperture proximate a first end thereof having a curled lip, and defining a longitudinal slot mediate said aperture and a second end of said elongated body having uneven parallel side edges joined at a topmost portion of said longitudinal slot by an oblique edge which forms an acute angle with a longer of said uneven parallel side edges and having a flange extending around a perimeter of said longitudinal slot except for a portion of said perimeter of said longitudinal slot proximate an intersection of said oblique edge and said longer parallel side edge of said longitudinal slot.

2. The invention of claim 1, wherein a portion of said elongated body between said aperture and said longitudinal slot is twisted so that a plane containing said aperture is disposed 90° with respect to a plane containing said longitudinal slot

3. The invention of claim 1, said elongated body, said curled lip and said flange comprising steel.

4. The invention of claim 3, wherein said steel is hardened.

5. The invention of claim 4, wherein said hardened steel is nickel-coated, hardened steel.

6. The invention of claim 1, wherein said acute angle is 30 degrees.

7. A drop wire comprising:

a flat elongated strip defining an aperture proximate a first end thereof having a curled lip, and defining a longitudinal slot mediate said aperture and a second end of said elongated body having first and second opposing longitudinal edges wherein said first edge is longer than said second edge and having an oblique edge joining said first and second opposing longitudinal edges so as to form an acute angle between said first longitudinal edge and said oblique edge and having a flange extending around a perimeter of said longitudinal slot except for a portion of said perimeter of said longitudinal slot proximate an intersection of said oblique edge and said first longitudinal edge of said longitudinal slot, and having a twist mediate said aperture and said longitudinal slot so that a plane containing said aperture is disposed 90° with respect to a plane containing said longitudinal slot.

8. The invention of claim 7, said elongated body, said curled lip and said flange comprising steel.

9. The invention of claim 8, wherein said steel is hardened.

10. The invention of claim 9, wherein said hardened steel is nickel-coated hardened steel.

11. The invention of claim 7, wherein said acute angle is 30 degrees.

12. A drop wire comprising:

a flat elongated strip defining an aperture proximate a first end thereof having a curled lip, and defining a longitudinal slot mediate said aperture and a second end of said elongated body having first and second opposing longitudinal edges wherein said first edge is longer than said second edge and having an oblique edge joining said first and second opposing longitudinal edges so as to form an acute angle between said first longitudinal edge and said oblique edge and having a flange extending around a perimeter of said longitudinal slot except for a portion of said perimeter of said longitudinal slot proximate an intersection of said oblique edge and said first longitudinal edge of said longitudinal slot.

13. The invention of claim 12, said elongated body, said curled lip and said flange comprising steel.

14. The invention of claim 13, wherein said steel is hardened.

15. The invention of claim 14, wherein said hardened steel is nickel-coated hardened steel.

* * * * *